United States Patent [19]

Lynn

[11] Patent Number: 4,809,377

[45] Date of Patent: Mar. 7, 1989

[54] SHEET RETAINER FOR WATERBEDS

[76] Inventor: Gerald Lynn, R.R. No. 2, Lucan, Ontario, Canada, N0N 2J0

[21] Appl. No.: 24,009

[22] Filed: Mar. 10, 1987

[51] Int. Cl.[4] ..... A47C 21/02

[52] U.S. Cl. ..... 5/508; 5/498; 24/72.5

[58] Field of Search ..... 5/508, 496, 498, 451; 24/72.5

[56] References Cited

U.S. PATENT DOCUMENTS

| | | | |
|---|---|---|---|
| 1,559,352 | 10/1925 | Nelson | 24/72.5 |
| 2,791,784 | 5/1957 | Tomsic | 5/496 |
| 4,520,518 | 6/1985 | Reaser | 5/496 |
| 4,521,970 | 6/1985 | Jester | 24/72.5 |
| 4,541,137 | 9/1985 | Murray | 5/498 |

*Primary Examiner*—Alexander Grosz

[57] ABSTRACT

A device for retaining sheets about the edge of a mattress is adapted to be placed between the mattress and a support surface with a portion of the sheet received in a channel-like recess of the retainer and held therein to restrict undesired withdrawal of the sheet therefrom. The retainer has a flat shank portion and a downwardly directed lip at one end thereof with the lip defining a recess for receiving a portion of the sheet therebehind. In a modified structure the sheet retainer includes a first and second member which are movable from a sheet retaining position to a non-sheet retaining position to facilitate insertion of a sheet therewithin. The members define a channel recess which receives a portion of the other member, with the members cooperating to restrict inadvertent withdrawal of the sheet from the retainer when received in the device.

13 Claims, 3 Drawing Sheets

FIG. 3.
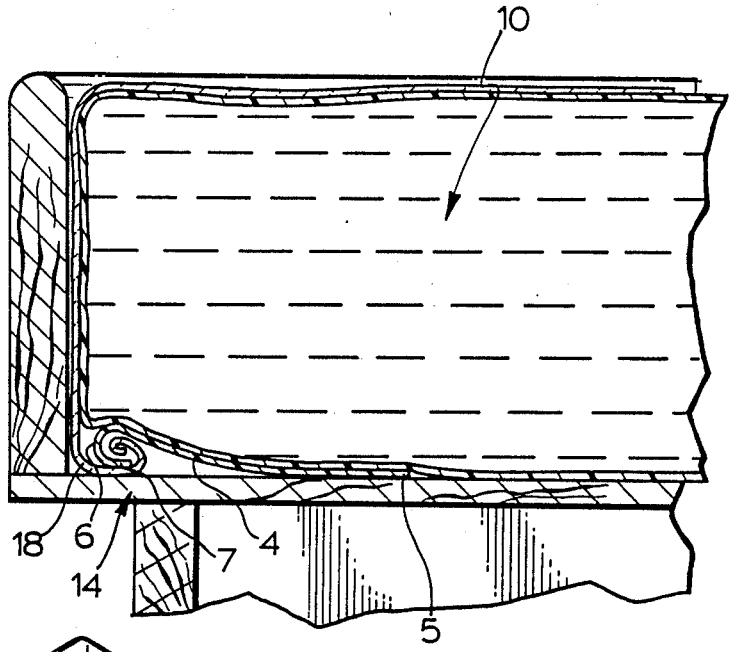
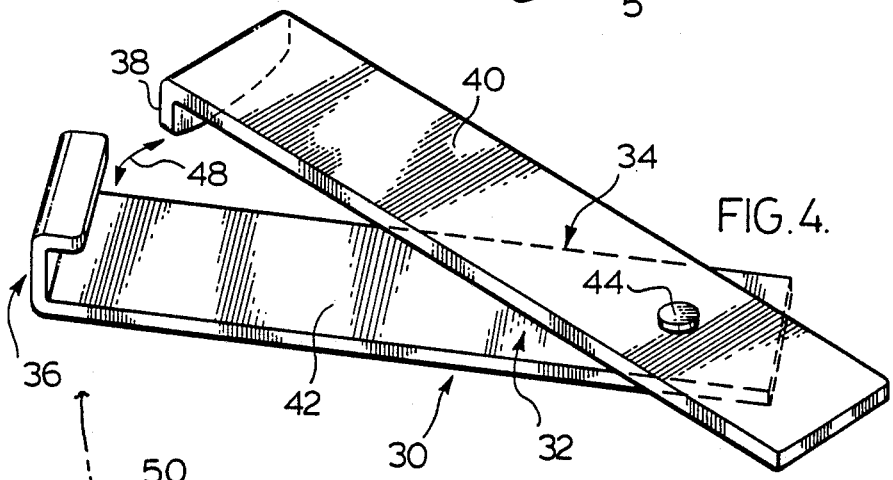
FIG. 4.
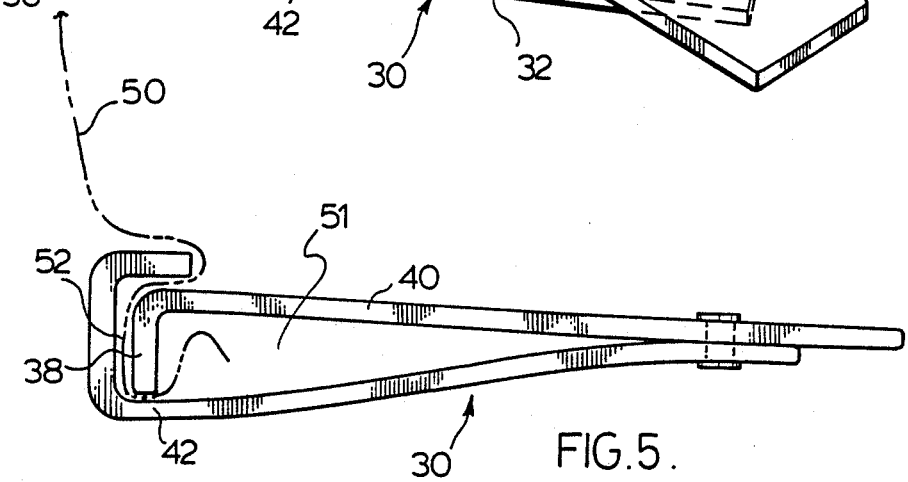
FIG. 5.

SHEET RETAINER FOR WATERBEDS

FIELD OF THE INVENTION

The present invention relates to devices for maintaining sheets about the edge of a mattress and, in particular, is directed to retaining the bottom sheet about the edge of the mattress. This device has particular application for use in association with waterbed mattresses.

BACKGROUND OF THE INVENTION

Everyone has experienced, on occasion, the frustration associated with the inadvertent removal of sheets or retention of sheets beneath a mattress and contoured sheets having elasticized portions for snugly engaging about the lower periphery of a mattress have been designed to overcome this problem, at least with respect to bottom sheets. Contoured sheets or fitted sheets have proven very popular and generally work satisfactorily with respect to a standard mattress. The problem of inadvertent sheet removal is more acute with respect to waterbed mattresses where, due to their inherent characteristics, retention of sheets thereabout is more difficult.

The present invention seeks to provide a simple solution to firmly retain sheets tucked beneath a mattress.

SUMMARY OF THE INVENTION

According to the present invention a sheet retainer for engaging a sheet intermediate a mattress and the support structure is disclosed. The retainer is to be position adjacent a corner of the mattress and has a long flat shank portion and a downwardly directed lip at one end thereof. The lip serves to space the shank from the support surface and the weight of the mattress serves to bias the lip into engagement with the support surface. A sheet may be disposed to engage the backside of the lip and pass intermediate the lip and the support surface whereby the pressure on the shank portion serves to maintain the sheet within the recess. As the shank is fairly long, inadvertent removal of the sheet requires pulling the retainer from between the mattress and the support surface and sufficient frictional forces are generated due to the weight of the mattress that this is not common and does not occur under normal conditions. In problem situations, a retainer would be disposed under each corner of the bed, however there are obvious benefits if the retainer is merely disposed under the most common problem area, ie. at the bottom corners of the mattress.

According to an aspect of the invention, a modified sheet retainer includes first and second members pivotally secured at one end thereof with the opposite ends movable from a position retaining and engaging a sheet to a non-retaining position to allow a sheet to be inserted in the retainer. The first member has at the end opposite the pivot connection a channel recess and the second member has a flange disposed to be received within said recess when the members are in the retaining position. The flange and the portion of the second member received in her recess define in combination with the first member a path therebetween of a shape to cause a portion of sheet when received therein to be reversed upon itself. This reverse configuration of the sheet makes removal of the sheet from the device difficult.

BRIEF DESCRIPTION OF THE DRAWINGS

Preferred embodiments of the invention are shown in the drawing wherein:

FIG. 3 is a sectional view through a waterbed mattress showing a sheet retainer appropriately positioned;

FIG. 4 is a perspective view of a modified sheet retaining device;

FIG. 5 is a side view of the sheet retaining device of FIG. 4; and

DETAILED DESCRIPTION OF THE PREFERRED EMBODIMENTS

Figure 1:
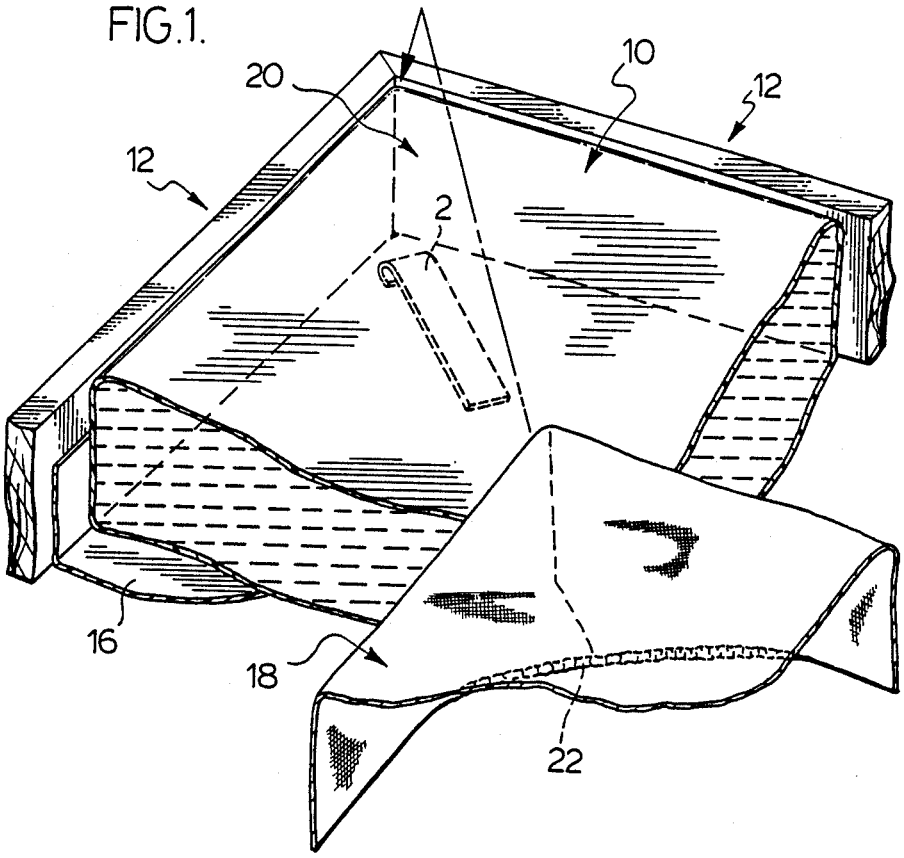
FIG. 1 is a partial perspective view of a waterbed.
Figure 2:
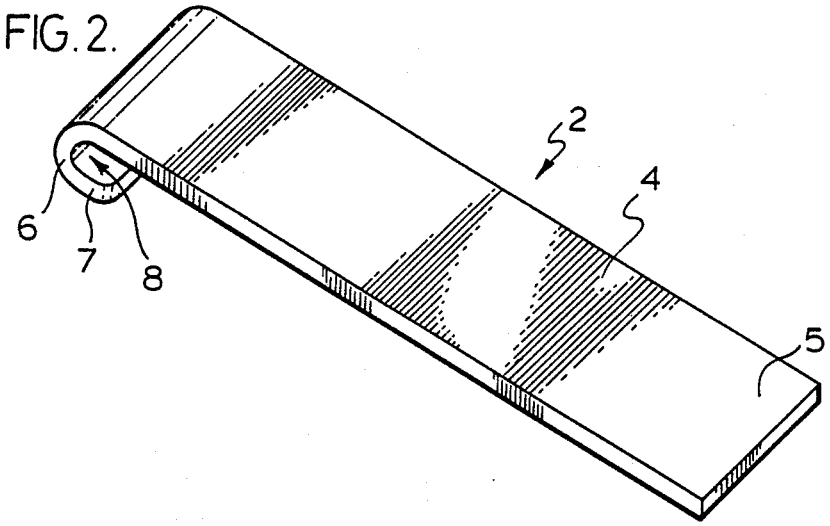
FIG. 2 is a perspective view of the sheet retainer.
Figure 6:
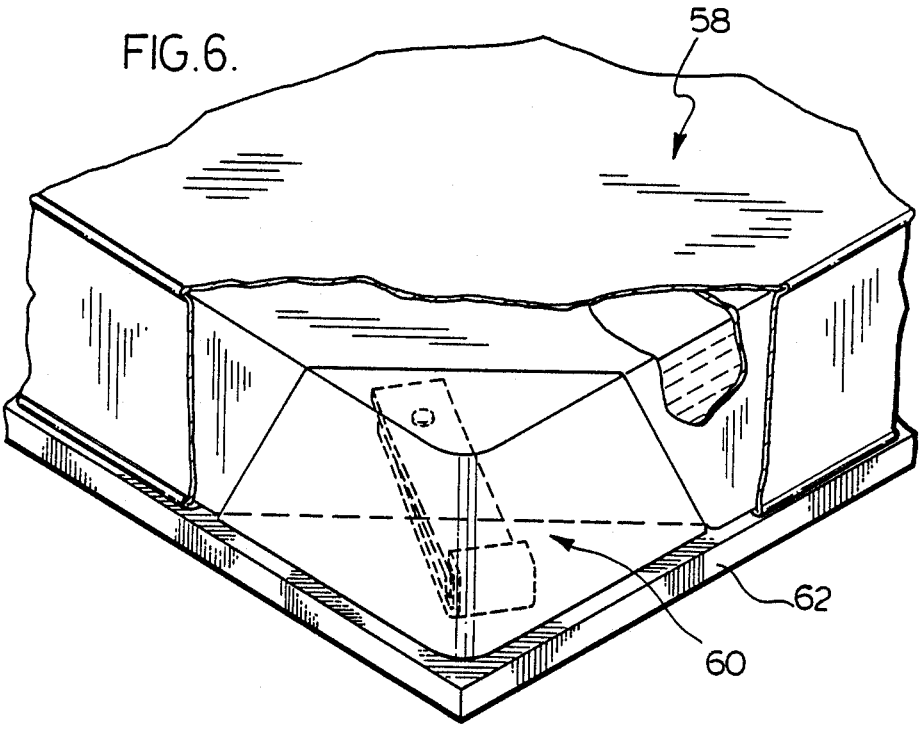
FIG. 6 is a partial perspective view showing the modified sheet retainer position between a waterbed mattress and a support member.

The sheet retainer generally shown as 2 has a long planar shank portion 4 with a lip or channel portion generally designated as 6 adjacent one end thereof. The opposite end 5 of the shank cooperates with the channel 6 and particularly the side 7 of the channel 6 to space the shank 4 generally above the support surface of the mattress. Such a support surface is shown in FIG. 3 as 14 and it can be seen that the shank 4 is bending under the weight of the mattress 10, with the support area at end 5 increasing and the side 7 of the channel 6 being pressed against the underlying support surface 14. Thus pressure is being applied to the portion of the sheet underlying the portion 7 of the channel. End 5 of the shank 4 and side 7 cooperate to support the shank, and apply pressure to the sheet 18. The recess 8 within the channel 6 is sufficient to receive the elasticized portion of a sheet or a peripheral portion of the sheet such that force on the sheet trying to withdraw the same from underneath the mattress requires a lifting action on the end of the sheet retainer 2 which is opposed by the weight of the mattress and, thus, the sheet must not only lift the retainer, it must lift the weight of the mattress which is biasing the retainer into contact with the support 14. By positioning a sheet retainer 2 at each of the corners of the mattress, or particularly at the bottom corners of the mattress, both the bottom sheet and the top sheet may be maintained beneath the mattress when they are in engagement with the channel 6. A the channel 6 is located approximate the corner of the mattress, there is no difficult in locally deforming the mattress to secure the sheet with the retainer 2. Removal of the sheet by tugging on the same is difficult as the shank is biased by a larger area of the mattress and a portion of the shank at end 5 has bottomed out on the support. The shank and channel are preferably of a width in excess of about two inches and the shank is of a length in excess of about eight inches. A modified sheet retainer is shown in FIGS. 4, 5 and 6 and is preferred for mattresses which are self-supporting and do not have the peripheral rails of the waterbed example of FIG. 1 and 3. In mattresses as illustrated in FIG. 6, the sheets have somewhat greater freedom and a more firm locking of the sheets is provided by the two component retainer 30 of FIGS. 4 through 6. The modified sheet retainer 30 includes a first member 32 which has a shank portion 42 in contact with a support surface 62 of the mattress 58 and a second member 34 which cooperates with the first member to effect locking of the sheet. The second member includes a flange 38 which is received within the channel 36 of the first member 32. The flange 38 is disposed within the channel at a point spaced from the bottom and beneath the upper edge of the channel to define a path for the sheet which requires a reversed direction as generally indicated in FIG. 5. The sheet 50 has a portion 52 received within the sheet retainer which is reversed upon itself as it passes over shank 40 of the second member and over flange 38 and between flange 38 and the opposed portion of the channel 36. The modified sheet retainer 39 is positioned beneath the mattress 58 and above the support 62 in the same manner as described with respect to FIG. 1, and similarly, the weight of the mattress contacts the shank 40 of the second member 34 with this shank generally supported adjacent its ends, ie. adjacent the pivot connection 44 and adjacent the flange 38. Therefore, the intermediate portion will bend under the weight of the mattress and reinforce the binding relationship between the first and second member and a sheet retainer therein.

As illustrated in FIG. 4, the first and second are horizontally separable by pivotting the same about the pivot connection 44 in a manner as generally indicated by 48, and in the non-retaining position of FIG. 4, a sheet may be inserted within the channel recess 36. With a sheet so inserted, the second member 34 may be moved back into the retaining position as shown in FIG. 5, such that the sheet is intermediate the first and second members of the retainer 30. Any excess sheet can accumulate within the central recess generally indicated as 51. As in the other embodiment, a force exerted on sheet 50 in an effort to remove the same from the retainer causes a lifting force on the retainer opposed by the weight of the mattress. This force also causes a lifting of the flange causing shank 40 to engage the opposed portion of the channel 36 and thereby increase the binding force exerted on the sheet.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination a sheet retainer, a sheet, a bed mattress and a mattress support, said sheet providing a bottom contoured sheet of said mattress and having at least elastic corner regions, said retainer having a long shank with a flange region at one end thereof, said retainer being disposed at a corner of said mattress intermediate said mattress and the underlying support, said flange being adjacent said corner with said shank extending generally inwardly, said mattress contacting said shank and biasing said flange into pressure contact with said support, said elasticized portion of said sheet being retained behind said flange with said flange engaging said sheet intermediate said flange and said support.

2. In a bed having a mattress, an underlying support and a bottom sheet, a sheet retaining device for retaining the sheet about the edge of the mattress comprising a long, generally planar shank having a 'U' shaped channel at one end thereof, said channel having a side thereof opposite said planar shank and an end of said shank opposite said channel portion supporting said shank at a position generally spaced from the mattress support, said shank partially supporting the weight of said mattress which biases said side of said channel into contact with said support, said sheet having a portion thereof received in said 'U' shaped channel with an adjacent portion of said sheet being located intermediate said channel and said support.

3. In a bed as claimed in claim 2 wherein said shank and channel are of a width in excess of about two inches.

4. In a bed as claimed in claim 3 wherein said shank is of a length of at least about eight inches.

5. In a bed as claimed in claim 4 wherein said mattress is a waterbed mattress.

6. In a bed as claimed in claim 5 wherein said bottom sheet is a contoured bottom sheet having elasticized corner portions, one of which is received in said 'U' shaped channel of said sheet retaining device.

7. In a bed as claimed in claim 6 wherein four sheet retainers are provided, each located at a corner of said mattress intermediate said mattress and said support.

8. In combination of a sheet retainer for maintaining a sheet relative to a mattress, and a bottom supported mattress, said sheet retainer being located adjacent an edge of said mattress to underlie said mattress, said retainer having a flat shank and a downwardly directed lip at one end thereof which defines a recess behind said lip for receiving a portion of a sheet, said flat shank cooperating with said mattress whereby weight of said mattress loaded on said shank serves to maintain the position of said retainer relative to said mattress and maintain such portion of a sheet behind said lip.

9. In combination as claimed in claim 8 wherein said downwardly directed lip in cooperation with a portion of said shank defines a 'U' shaped channel.

10. In combination as claimed in claim 9 wherein said shank and channel are of a width in excess of two inches and wherein said shank is of a length of at least about eight inches.

11. A sheet retainer for engaging a sheet intermediate a mattress and a support structure adjacent a corner of the mattress, said retainer having an elongated shank and a downwardly directed lip at one end thereof, said lip defining a recess therebehind for receiving a portion of a sheet, said shank being generally planar and having a bottom surface at the shank end opposite said lip which provides a flat contact area of the shank and such support structure such that said lip and said contact area cooperate to support said shank at an angle when placed on such support structure; said shank being of a material that allows resilient bending on said shank to thereby substantially increase the contact area when said retainer is loaded with the weight of a mattress.

12. A sheet retainer as claimed in claim 11 wherein said shank is planar and terminates at said shank end opposite said lip.

13. A sheet retainer as claimed in claim 12 wherein said lip is shaped to form a 'U' shaped channel in cooperation with a portion of said shank.

* * * * *